United States Patent [19]

Heinen et al.

[11] 4,048,875

[45] Sept. 20, 1977

[54] APPARATUS FOR SCREWING A THREADED NUT ONTO A STEEL ROD

[75] Inventors: Richard Heinen, New York, N.Y.; Georg Rieger, Unterpfaffenhofen, Germany

[73] Assignee: Dyckerhoff & Widmann Aktiengesellschaft, Munich, Germany

[21] Appl. No.: 739,870

[22] Filed: Nov. 9, 1976

[30] Foreign Application Priority Data

June 12, 1976 Germany ..... 7618699[U]

[51] Int. Cl.[2] ..... B25B 13/48

[52] U.S. Cl. ..... 81/125; 81/55; 81/121 R; 61/45 B

[58] Field of Search ..... 81/53 R, 53.2, 55, 56, 81/121 R, 125; 61/45 B, 63

[56] References Cited

U.S. PATENT DOCUMENTS

| | | | |
|---|---|---|---|
| 3,413,876 | 12/1968 | Shinn | 81/53.2 |
| 3,485,118 | 12/1969 | Maughan | 81/55 X |
| 3,693,484 | 9/1972 | Sanderson | 81/53.2 X |
| 3,889,558 | 6/1975 | Duncan | 81/55 |
| 3,916,734 | 11/1975 | Sawan | 81/55 X |
| 3,935,760 | 2/1976 | Taylor | 81/55 |

*Primary Examiner*—James L. Jones, Jr.
*Assistant Examiner*—James G. Smith
*Attorney, Agent, or Firm*—Frank L. Durr; Orville N. Greene

[57] ABSTRACT

The tool or device of the invention operates on an anchoring rod of the type which has spiral threads which threads only extend around a portion of the circumference thereof. Such an anchoring rod, when used to secure ceilings in mines, for example, has to be screwed into anchoring position and then have a nut screwed in the free end thereof to secure it against a steel plate applied against the wall of the ceiling. The device of the invention is in the form of a sleeve having an aperture at one end adapted to receive the nut to be applied and a means at the other end to connect to a torque applying device. Back of the nut receiving aperture, means are provided in the sleeve device which can, optionally, cause the rod, the end of which extends through the nut, to rotate with the sleeve, or to remain stationary while the nut is screwed thereon, whereby the insertion of the rods into the bore holes and the tightening of the nut thereon, can be accomplished rapidly with only one fitting of the tool thereon.

14 Claims, 17 Drawing Figures

Figure 1:
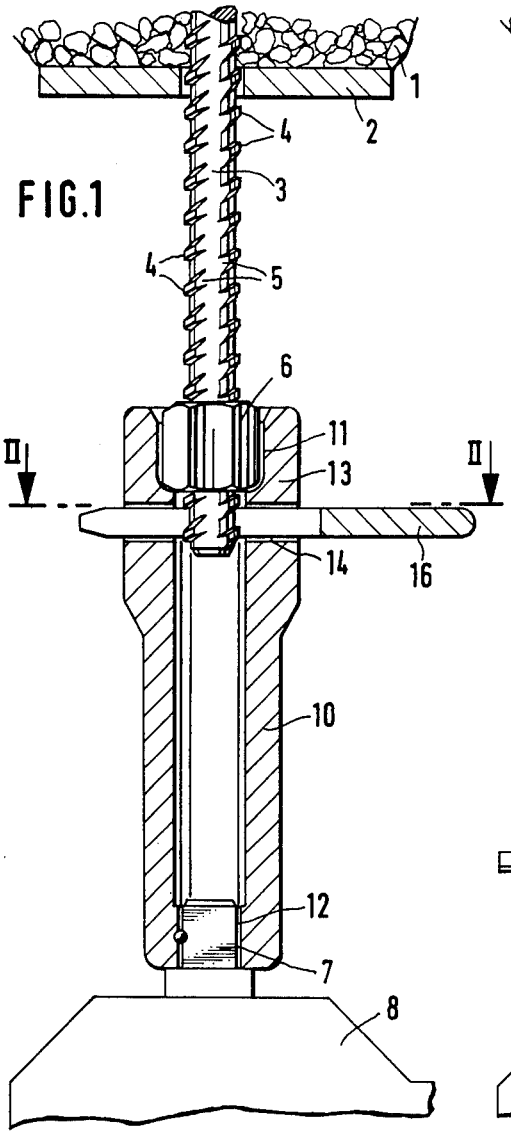

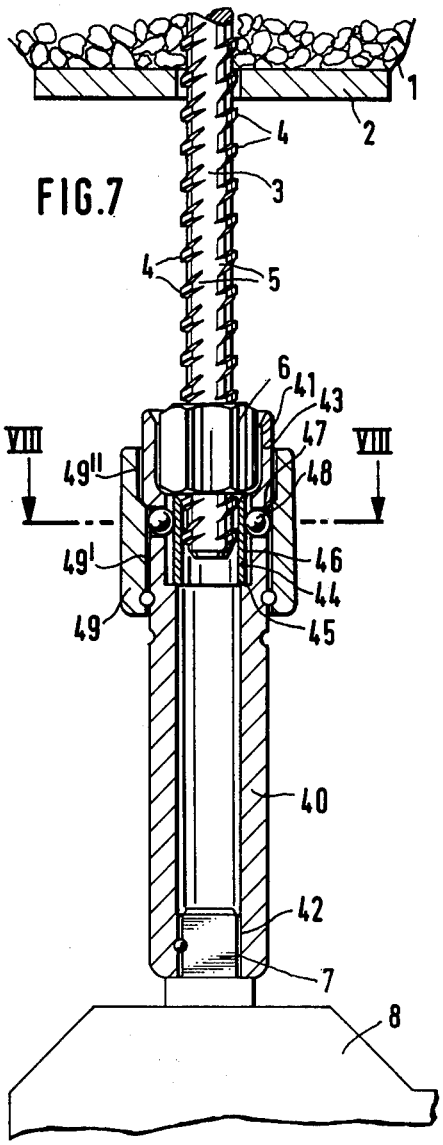
FIG.7
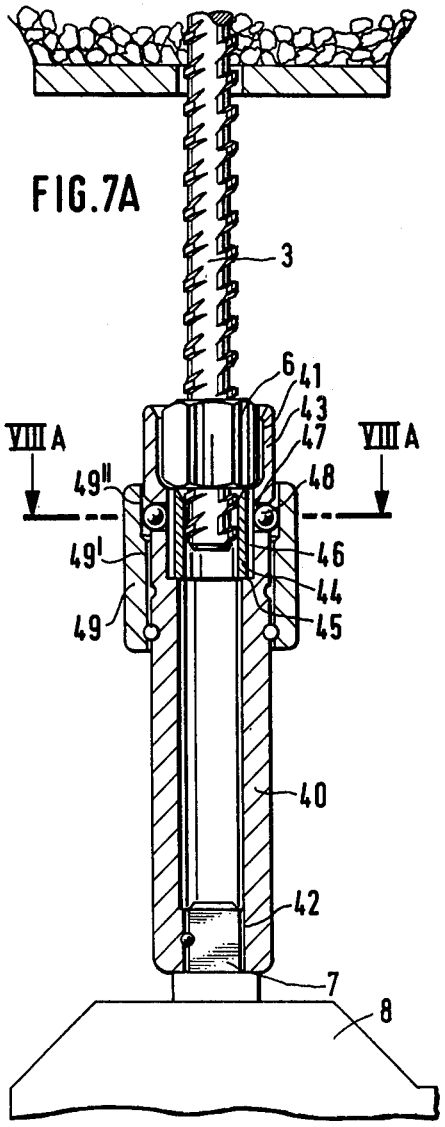
FIG.7A
FIG.8
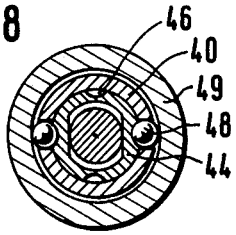
FIG.8A
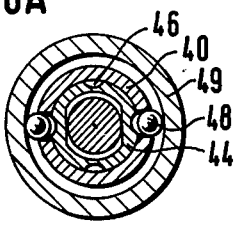

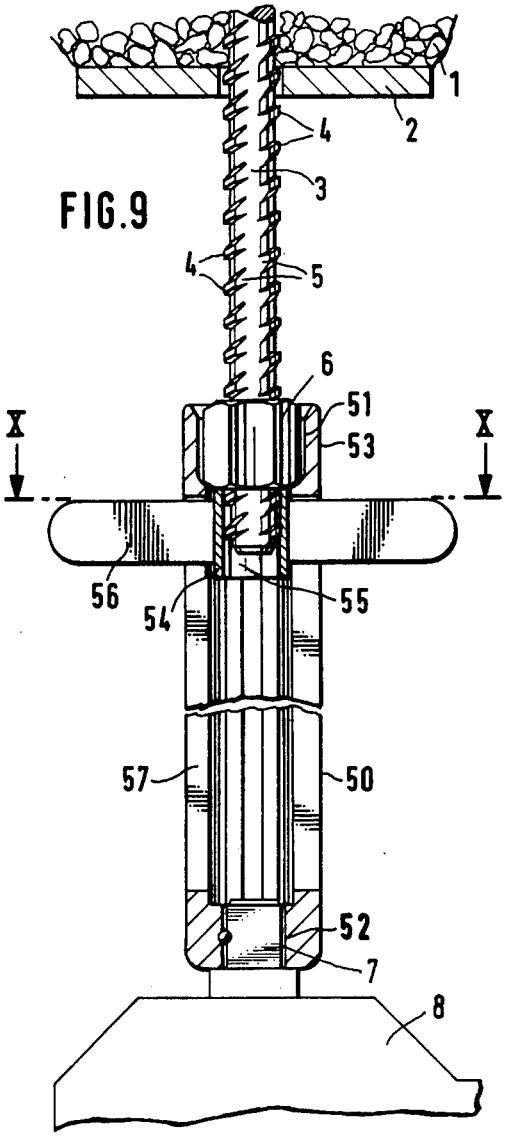
FIG.9
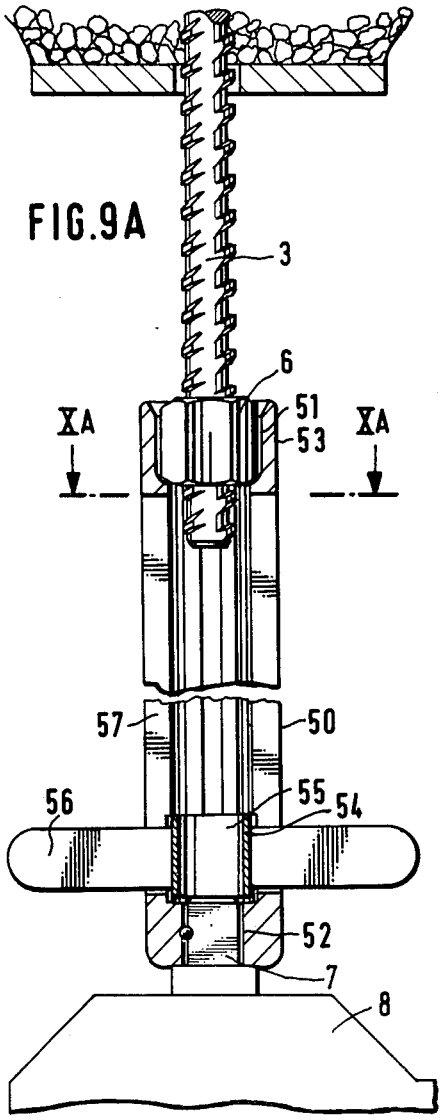
FIG.9A
FIG.10
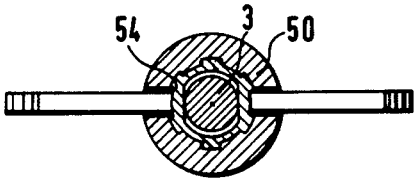
FIG.10A
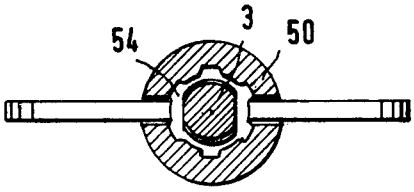

APPARATUS FOR SCREWING A THREADED NUT ONTO A STEEL ROD

The invention concerns a device for screwing a threaded nut onto the type of steel rod that is provided on two opposite facing sides with ribs forming a partial exterior thread lying in a helical line, said ribs always extending over only a part of the rod circumference to provide bare or flattened frontal areas from which the ribs slope oppositely to one another, the device consisting of a tubular jacket which at one end has a recess in the form of a nut and which at the other end is provided with means for the receiption of a twisting moment.

In mining, overhead anchors are inserted for securing the layers. For this purpose, the so-called cement anchors are used to a large extent. These are anchors for the manufacture of which cartridges are inserted in rough drilled holes, in which plastic cementing material is stored in closed containers. Thereby, a quick setting cement is available for the anchor in the anchoring area; in the area of the open span length, a slower hardening cement can be provided which serves essentially for corrosion protection. In the borehole containing the cementing cartridge, the tension member of the anchor, preferably a steel rod, is inserted, whereby the chamber of the cartridge opens and the cementing material is admitted into contact with the steel rod on the one hand and the bore hole walls on the other hand. As soon as the quick hardening cement is hardened in the anchoring area, at least one nut is screwed from the end of the threading provided on the rod which is tightened against an adjacent anchor plate on the rock. The anchor is thereby ready for working.

Steel rods which have especial advantages for use as a tensioning member for such an anchor, are those which are provided with hot rolled screw-aligned developed ribs which are arranged on two opposite sides of the rod circumference and which ribs form part of a screw thread (DT-PS No. 1784630). The ribs extend in full height only over about a third of the rod circumference, whereby they form a flattened surface at the sides from which they slope in opposite directions as seen from the sides. The rods have, therefore, special advantages because the threads necessary for screwing in the anchoring body can already be produced in the rolling process so that no further finishing operations are necessary for producing a thread. The partial winding of the formed ribs at the same time work to increase adhesion.

For the application of such a steel rod to a cementing anchor, two sequential operations are required. After the borehole is bored and the cementing cartridge is inserted, the rod is screwed into the cartridge. To do this, a device is necessary which provides for transmitting a twisted motion to the rod. This device is removed after the rod is screwed in. After a certain hardening time for the cement in the anchoring area, the rod is to be tensioned by screwing on a nut. For this purpose, an anchor plate is put on, a nut screwed on and the nut tightened by means of a torque wrench or other suitable tool.

The problem of this invention is to make possible the combination of these two sequential operations to be undertaken, and thus to save the time required for attaching different work tools and to work more economically.

According to the invention, this problem is solved by providing a sleeve, which has a recess at one end to receive the nut for transmitting rotating movement from a suitable tool to the nut and means at the other end for transmitting rotating motion thereto with means for establishing a force locking connection between the steel rod and the sleeve, wherein said connection operates on the flat faces of the rod so as to rotate the rod with the sleeve.

According to the invention, the characteristic of the steel rods mentioned above are utilized so that the ribs extend only over a part of the circumference and that so that they slope oppositely to one another when passing transversely of the bare core cross-section. The rod, which in cross-section has biaxial symmetry but not radial symmetry, can be blocked against rotation with respect to the sleeve by virtue of its structure and the arrangement of the connecting surfaces in the interior of the housing. Thus, the possibility is created, while this blocking is in effect, with the torque moment supplying arrangement in operation and with the threaded nut superposed adjacent the end of the rod, to first screw the steel rod into the bore or into the cementing cartridge and after the hardening time of the cement, with the blocking means released, to screw the nut onto the rod and tighten it with an appropriate twisting moment.

Advantageous embodiments of the apparatus of the invention are set forth in the claims.

Figure 2:
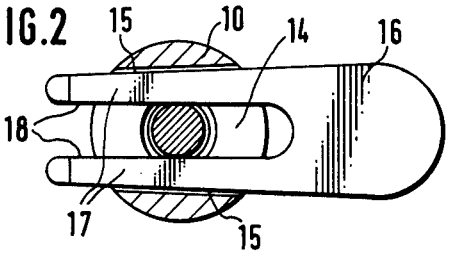
Figure 11:
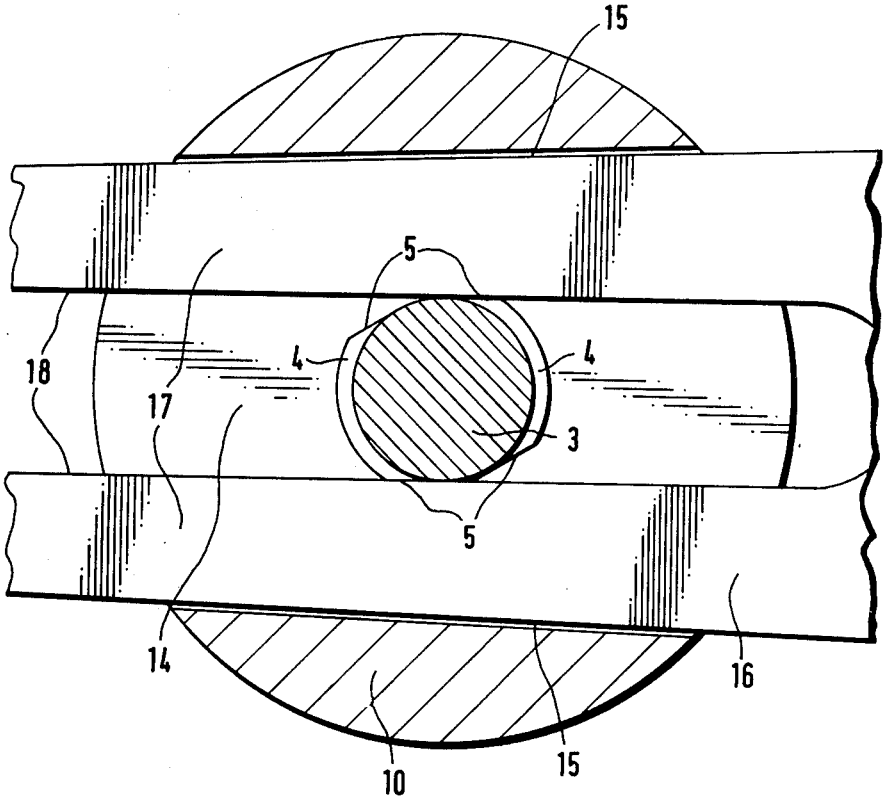

The invention will now be further explained in connection with the examples of the embodiments thereof shown in the drawing in which:

FIGS. 1–10 are pairs of longitudinal and cross-sectional views respectively of different forms of the device and FIG. 11 is a cross-sectional view taken from FIG. 2 but greatly enlarged.

FIG. 1 is the longitudinal view and FIG. 2 is a cross-sectional view taken on line II — II of FIG. 1 of a first form of the invention. In FIG. 1, a steel anchor plate 2 is positioned on rock 1. A steel rod 3 extends into a bore hole (not completely shown), which rod possesses on opposite sides, hot-rolled ribs 4, which in the normal rod surfaces at the relatively flat transition surfaces 5 slope oppositely to one another. On the rod 3, a nut 6 is screwed which has an interior thread and accordingly can be screwed onto the partial threads of the rod. Through tightening the nut against the anchor plate 2, a tensile force can be introduced in the rod.

On the nut 6, a sleeve 10 is positioned which, at one end, has the opening 11 e.g. with 12 interior edges, corresponding to the outline of the nut 6, and in the other end has an opening 12 in which a lug 7, e.g., a square key, of a work tool 8, can be inserted to operate to transmit twisting moments to the sleeve 10 and to the nut 6.

The sleeve 10 has on its upper, somewhat thickened area 13, a passageway 14 with wedge form inner surfaces 15 sloping slightly towards one another. In the passageway 15, a forked key 16 can be driven in whose two parallel legs 17 form with their inner sides 18, a mating edge for the facing surfaces 5 of the ribs 4 of the rod 3. Thereby, the rod 3 is rotated somewhat by twisting moments until two diametrically opposed facial areas 5 are adjacent to the inner surfaces 18 of key 16. In this state, the twisting moment exerted by the device 8 on the sleeve 10 will be transmitted to the rod 3. After withdrawing the key 16, the rod 3 is free, so that the twisting moment then works on the nut 6 to screw the latter onto the rod 3 and tighten it against the anchor plate 2.

Figure 3:
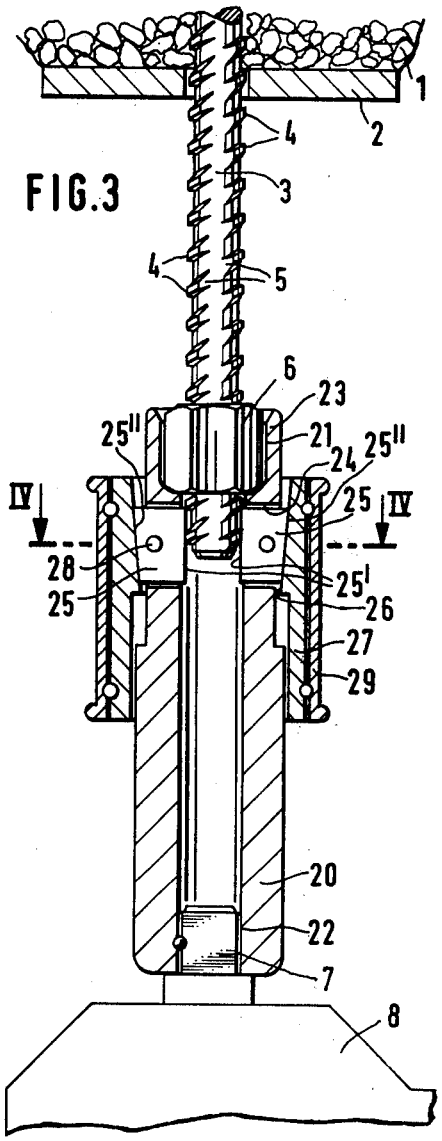
Figure 3A:
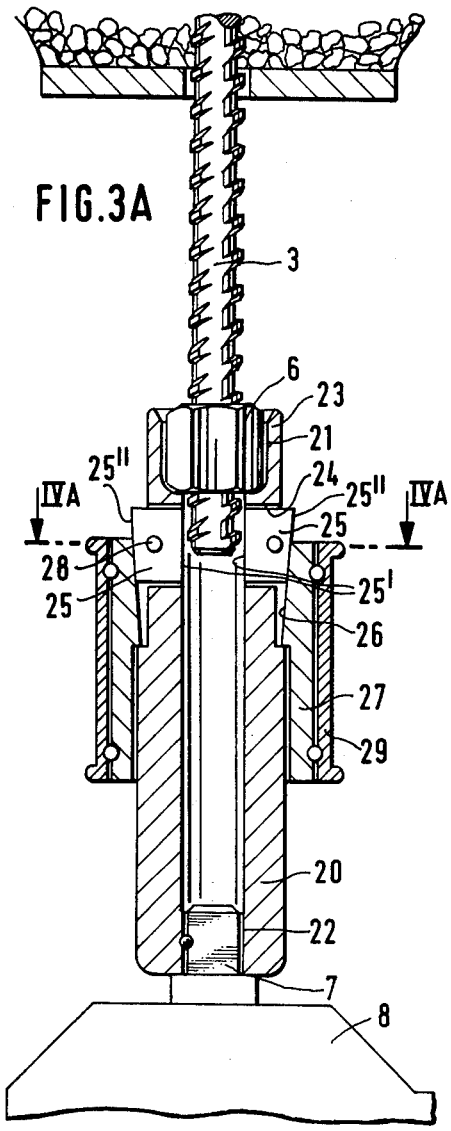
Figure 4:
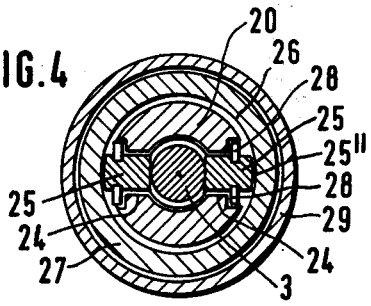
Figure 4A:
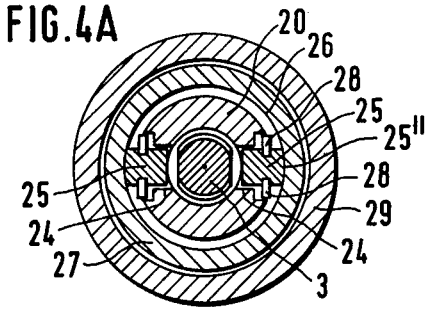

In FIGS. 3, 3A, 4 and 4A, another embodiment of the apparatus of the invention is shown. FIGS. 4 and 4A are cross-sectional views taken on line IV—IV or IVA—IVA of FIGS. 3 or 3A, respectively.

The sleeve 20 has the recess 21 at its upper somewhat narrowed end 23, which is again placed on nut 6. In this area of the sleeve there is again a transversely extending passageway 24 in which two opposing transversely shiftable clamping jaws 25 are arranged on opposite sides of the sleeve 20. The clamping jaws 25, with their inner surfaces 25', which face towards the rod 3, form stops for the facing surface 5 of the ribs 4 or the rods 3, while they have inclined surfaces 25" on the outer side which are adjacent to a conical boring 26 of a bushing 27 which is shiftable longitudinally of the sleeve 20. If the bushing 27 of FIG. 3 is shifted upwardly, then the conical sloping surface 26 exerts a radial inward pressure on the clamping jaws 25 which closes them about the flat surface 5 of rod 3 (left hand part of FIG. 3). If the bushing 27 is shifted downward then the clamps, which are prevented from being drawn in by the pegs 28 are free of the rod 3 and the rod does not rotate with the sleeve. For easy servicing, a gripping sleeve 29 can be positioned over the bushing 27, which can be held fast by the hand, for example, to hold the bushing 27 in the blocking state to rotate the rod 3 with the sleeve 20.

Figure 5:
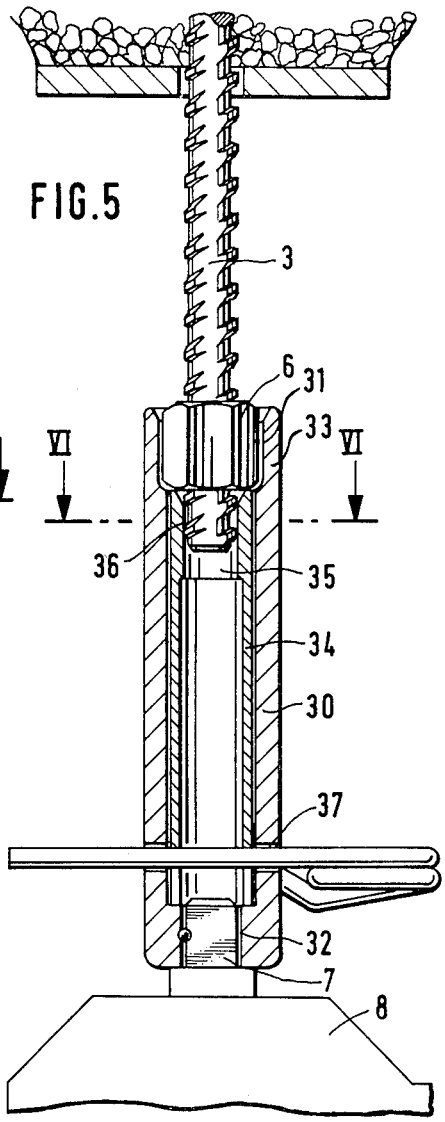
Figure 6:
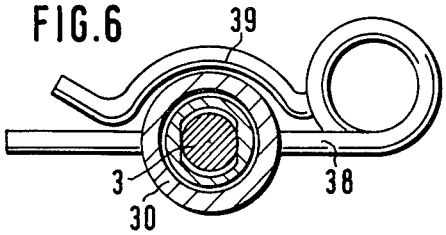

A further embodiment of the invention is shown in FIGS. 5 and 6 of which FIG. 6 is a cross-sectional view taken along line VI—VI of FIG. 5.

The sleeve 30 has, at its upper end 33, again a recess 31 for reception of the nut 6. At the lower end is another recess 32 for receiving the square key 7 of the device 8 for exerting the rotating movement. In the cylindrical inner space of sleeve 30, a bushing 34 is arranged having an inner hollow space (at least in its upper area 36) which corresponds to the cross-section of rod 3. The bushing 34 can, thus, when it is pushed onto the rod 3, prevent rod 3 from rotating with respect thereto.

In the lower area of the sleeve 30, cross bores 37 are provided, which pass through the sleeve 20 as well as the bushing 34 and which can be brought into alignment with one another. A cotter 38 is pinned through the borings 37 and makes a rigid connection between the sleeve 30 and the bushing 34. The cotter can consist of a bent steel wire which includes a spring portion 39 which acts as a certain locking mechanism to locate the cotter in a predetermined position with respect to the sleeve 30. If the cotter 38 is withdrawn, then the bushing 34 within the sleeve 38 is freely movable, so that the nut 6 can be screwed onto the rod by means of the sleeve 30.

In FIGS. 7 and 7A, a further modified form of the invention is shown with FIGS. 8 and 8A respectively being cross-sectional views taken on lines VIII—VIII and VIIIA—VIIIA of FIGS. 7 and 7A respectively.

In these modifications the sleeve 40, which again is provided with the recess 41 in the upper portion 43 and with a recess 42 for the square key 7, has a bushing 44 in its upper portion. The bushing 44, which rests on the shoulder 45 and is prevented from falling thereby, has on its outer circumference longitudinal grooves 46 with arcuate-form cross-section. In the transverse boring 47 of the sleeve 40, spheres 48 are situated which are movable radially. By means of an outer bushing 49 which has an area 49' with one internal diameter and an area 49" with a larger internal diameter, the spheres 48 are held within said bushing 49 in one of two positions, in the first of which positions the walls obstruct the sleeve 40 (FIG. 7). By lowering the outer sleeve 47, the spheres 48 have greater play and free the inner bushing 44, so that in this position the rotating force exerted by the square key of device 8 operates only on the nut 6.

A further modified form of the invention is shown in FIGS. 9 and 9A together with FIGS. 10 and 10A, which again are cross-sectional views taken on lines X—X and XA—XA of FIGS. 9 and 9A, respectively.

Also, here the sleeve 50 has, in its upper area, the recess 51 for taking up the nut 6, on the opposite end a recess 52 for taking up the square key 7. In the sleeve 50, a bushing 54 is lengthwise slidably, but not rotatably, arranged. This can, as FIG. 10 shows, have a serrated cross-section which is slidably arranged in corresponding recesses in the sleeve 50. The bushing 54 possesses again, an inner recess 55 which corresponds to that of the rod 3. On the bushing 54, a hand grip 56 is fastened which is movable in the longitudinal slots 57 of the sleeve 50.

In the position shown in FIG. 9, the bushing 54 is in meshing engagement with the rod 3. In this position, the twisting moment will be transmitted to the rod 3. To loosen the connection between the bushing 54 and the rod 3, the bushing is moved downward by the handles 56, thereupon the rod becomes free and the twisting moment is transmitted directly to the nut 6 (FIG. 9A).

I claim:

1. A device for screwing a threaded nut onto a rod of the type which has a partial spiral winding made up of spirally arranged ribs positioned on opposite sides thereof to leave substantially planar areas on opposite sides of the rods between the ribbed areas, the ribs sloping in opposite directions in passing from the planar areas, said device comprising a tubular sleeve adapted to surround a substantial length of ribbed rod and having a recess at a first end adapted to receive a nut to be screwed into the rod, means at the opposite end adapted to receive a driving means for imparting a twisting moment thereto, locking means cooperating with said sleeve adapted to releasably lock the sleeve onto a portion of the rod which extends through a threaded nut to which the first end of the sleeve is applied whereby rotation of the sleeve also rotates the rod when said locking means is operative, but permits the sleeve to rotate the nut with respect to the rod when the locking means is inoperative, said sleeve contains an opening extending transversely thereof, and said locking means operates in said opening.

2. The device as claimed in claim 1 wherein said sleeve contains an opening extending transversely thereof, and said locking means operates in said opening.

3. The device as claimed in claim 2, wherein said locking means comprises a two-pronged fork device, the transverse slot of said sleeve being adapted to receive the fork device, the inner surfaces of said prongs being formed to straddle the rod projecting into the sleeve and to fit closely on the planar areas of said rod.

4. The device as claimed in claim 2, wherein said locking means comprises two opposed, shiftable clamp means, said clamp means being positioned in said transverse opening and having inner surfaces which form clamping jaws for the planar areas of the rod and slanting outer surfaces, a bushing mounted to slide longitudinally on the outside of the sleeve, and interior surface of said bushing being frustoconical and being adapted to contact the slanting outer surfaces of the clamps to press the clamps inwardly on being moved longitudinally of the sleeve.

5. The device as claimed in claim 4 wherein said bushing is covered with a gripping sleeve.

6. The device as claimed in claim 1 wherein said locking means comprises a bushing freely mounted interiorly of the sleeve, one end of said internal bushing having a recess having an inner profile which approximately matches the outside of the rod so as to rotate the rod when it is rotated, said locking means also comprising releasable means for locking the sleeve to the internal bushing.

7. The device as claimed in claim 6, wherein said sleeve and internal bushing contain matching transverse openings, said releasable means for locking the sleeve to the bushing comprising a cotter which passes through said matching transverse openings.

8. The device as claimed in claim 6, wherein said cotter means includes a spring blade adapted to fit over the sleeve to hold the cotter in position.

9. The device as claimed in claim 6 wherein the internal bushing extends approximately the whole internal length of the sleeve.

10. The device as claimed in claim 6, wherein said sleeve containing a pair of opposed openings adjacent said recessed end of the bushing, said releasable means for locking the sleeve to the internal bushing comprising ball means inserted in said opposed openings and longitudinally shiftable exterior bushing surrounding the sleeve in the region of the openings and ball means, said exterior bushing having at least two internal bearing surfaces one of which presses the balls against the internal bushing to force the interior bushing to rotate with the sleeve.

11. The device as claimed in claim 10 wherein the sleeve and the exterior bushing have cooperating means thereon to arrest the longitudinal movement of the exterior bushing with respect to the sleeve at the proper points.

12. The device as claimed in claim 1 wherein said locking means comprises a bushing movable longitudinally in said sleeve but mounted to rotate with said sleeve and means to move the bushing into and out of engagement with said rod.

13. The device as claimed in claim 12 wherein the interior of said sleeve has a fluted surface matched by the outer surface of the bushing whereby to cause the bushing to rotate with the sleeve.

14. The device as claimed in claim 12 wherein said sleeve contains a pair of longitudinal slots, said movable bushing containing handles which extend through the slots to the outside of the sleeve whereby to facilitate movement of the bushing longitudinally in the sleeve.

* * * * *